US006050447A

United States Patent [19]

Kovens et al.

[11] Patent Number: 6,050,447

[45] Date of Patent: Apr. 18, 2000

[54] BULK VENDING MACHINE SYSTEM WITH MECHANICALLY OPERATED ELECTRICALLY ACTUATED LOCKING AND CONTROL FUNCTION

[75] Inventors: Steven A. Kovens, Owings Mills; Michael T. Gootee, Baltimore; Robert H. Tegtmeier, Phoenix, all of Md.; Ronald F. Deuel, Shrewsbury, Pa.

[73] Assignee: Parkway Machine Corporation, Timonium, Md.

[21] Appl. No.: 09/066,650

[22] Filed: Apr. 27, 1998

Related U.S. Application Data

[63] Continuation-in-part of application No. 08/967,939, Nov. 12, 1997.

[51] Int. Cl.[7] ..... A47F 1/10; G07F 11/62

[52] U.S. Cl. ..... 221/125; 221/129; 221/151; 221/152; 221/153; 221/155; 221/265; 221/13; 194/247

[58] Field of Search ..... 194/247; 221/151, 221/152, 153, 155, 265, 129, 125, 13

[56] References Cited

U.S. PATENT DOCUMENTS

| | | | |
|---|---|---|---|
| D. 314,402 | 2/1991 | Kovens . | |
| D. 314,794 | 2/1991 | Kovens . | |
| D. 344,762 | 3/1994 | Peterson | D20/7 |
| D. 347,448 | 5/1994 | Hinton . | |
| D. 370,694 | 6/1996 | Kovens et al. | D20/7 |
| D. 372,500 | 8/1996 | Hinton . | |
| D. 373,386 | 9/1996 | Beene et al. . | |
| D. 381,169 | 7/1997 | Kovens et al. | D34/21 |
| D. 387,385 | 12/1997 | Kovens et al. . | |
| 1,632,838 | 6/1927 | Higgins . | |
| 3,390,753 | 7/1968 | Bolden et al. . | |
| 3,604,547 | 9/1971 | Bolen | 194/2 |
| 3,822,004 | 7/1974 | Bolen | 194/15 |
| 4,000,800 | 1/1977 | Loucks, Sr. | 221/125 |
| 4,223,210 | 9/1980 | Verduin | 235/92 |
| 4,257,531 | 3/1981 | Kimura et al. | 221/227 |
| 4,311,227 | 1/1982 | Watkins | 194/4 |
| 4,354,613 | 10/1982 | Desai et al. | 221/4 |
| 4,386,691 | 6/1983 | Voigeli | 194/7 |
| 4,927,051 | 5/1990 | Falk | 221/12 |
| 4,967,896 | 11/1990 | Hara | 194/217 |
| 5,036,966 | 8/1991 | Kasper et al. | 194/217 |
| 5,172,605 | 12/1992 | Schwartz | 318/474 |
| 5,360,093 | 11/1994 | Baer | 194/206 |
| 5,564,547 | 10/1996 | Ranon et al. | 194/216 |
| 5,685,435 | 11/1997 | Picioccio et al. . | |
| 5,947,328 | 11/1997 | Kovens et al. | 221/129 |

*Primary Examiner*—Christopher P. Ellis
*Assistant Examiner*—Mark A. Deuble
*Attorney, Agent, or Firm*—Cahn & Samuels, LLP

[57] ABSTRACT

An electronically actuated and monitorable bulk vending machine assembly for electronically actuated vending from a select one of a plurality of rack mounted of bulk vending including at least one electrically lockable, crank actuated vending machine linked to a microprocessor controlled, interrogatable central control and currency acceptor unit and methods of assembly and use associated therewith.

17 Claims, 6 Drawing Sheets

BULK VENDING MACHINE SYSTEM WITH MECHANICALLY OPERATED ELECTRICALLY ACTUATED LOCKING AND CONTROL FUNCTION

RELATED APPLICATION

This is a continuation-in-part application to United States patent application Ser. No. 08/967,939 filed Nov. 12, 1997.

TECHNICAL FIELD

The present invention is directed to a variation of the improvements in bulk vending systems described in the above-identified United States Patent application. The variation of the present invention relates to assemblies and use of conventional mechanically rotatable crank handle operation with an electronic lockout assembly for use in an array of centrally controlled bulk vending machines. Thus, an electronic bulk vending machine assembly and system according to the invention, preserves the tactile (palpable touch, sensory) satisfaction enjoyed by customers from physically manipulating a device, e.g., rotating a conventional bulk vending machine crank handle while retaining the advantages of a centrally-controlled, electronic bulk dispensing system.

BACKGROUND OF THE INVENTION

Coin operated bulk vending machines of the type used to vend candy, nuts, capsules containing articles, gum, and the like are commonplace. Such devices typically are found in public locations such as stores, taverns, malls, etc. Conventional bulk vending machines comprise two primary operational segments, the merchandise storage globe and the base. The merchandise storage globe typically projects above the base and is supported by a nesting relation thereon. The base contains a coin receiving actuation mechanism for selected coinage and commonly features a merchandise discharge chute/chute cover assembly for dispensing vended goods. While gravity provides the predominant force utilized in dispensing merchandise from bulk vending machines, mechanical force must be generated to move the merchandise from the globe, through a segmented merchandise wheel to an underlying dispensing opening. Typically, such actuating force is provided by a crank handle linked through selected gearing to the rotatable, segmented merchandise wheel disposed intermediate of the globe. Typically, the wheel is associated with a plurality of radially directed spring brushes which rotate therewith to assist in the mechanical movement by sweeping the merchandise into one of the discrete wheel segments which rotates progressively within the hopper. Because the merchandise wheel is nested within the hopper, as it rotates, it transports the merchandise in a discrete segment to an underlying discharge opening corresponding to the top of a discharge chute.

In operation, after the appropriate, authorized coinage is placed in the coin slot(s) disposed in the mechanism, the manual crank handle is released to rotate one complete turn (360°). As the crank handle is turned, it imparts an amount of incremental rotation (e.g. 60° or quadrants) which is determined by the gearing, to the merchandise wheel and the brushes to cause the discharge of merchandise to the chute. Such machines are generally described in U.S. Pat. No. 5,467,858 and a conventional bulk vending coin mechanism is described in U.S. Pat. No. 5,111,928, both of which are incorporated herein by reference.

Due to a number of factors including inflation, coinage alone may no longer be the most practical means for vending. Bulk vending machines, which have been traditionally limited to coin actuation, are correspondingly limited in the amount and variety of articles that can be dispensed. That is based primarily on price points established not by the merchandise but rather by the limitations of a coin only mechanism. Furthermore, because bulk vending machines are located at sites remote from the operator, maintenance and serviceability problems may arise without the knowledge of the operator and the machines may remain inoperative for considerable periods of time, even in high traffic areas. In addition to maintenance problems, bulk vending machines are also susceptible to vandalism and theft by users or untrustworthy employees with access to the machines who cheat by pilfering merchandise or coinage. Thus, current bulk vending machines and assemblies lack accountability now commonplace in the increasingly electronic business environment. Notwithstanding these problems, due in part to the colorful amusement characteristics and the entertainment nature of the coin operated bulk vending industry; it has not previously lent itself to electronics.

Electronic vending machines are well known in the vending industry. (See U.S. Pat. No. 4,967,896 describing a price memory control arrangement for an automatic vending machine incorporated herein by reference). Such machines can rely on microprocessor controls as described in U.S. Pat. No. 4,354,613 (incorporated herein by reference). However, such electronic controls and equipment are dedicated to conventional stand-alone snack and beverage vending machines. An area of single item vending that has moved from mechanical to the electromechanical combinations is a multi-cabinet newspaper vendor relying on a single centralized, CPU based, control mechanism such as that disclosed in U.S. Pat. No. 5,360,093. However, this device only selectively unlocks vendor cabinet doors and does not contemplate actual article dispensing.

The concept of an electronically controlled bulk vending assembly system of simplified assembly, rack oriented bulk vending machines preserving the advantageous feelings of accomplishment occurring from successful physical manipulation of a machine while providing modern electronic controls appears to have escaped the industry previously. Such machines contemplate desirable advantages of centralized currency processing, signal processing, maximum operator flexibility, while preserving customer physical manipulation of the machine. Such machines also would facilitate establishing merchandise price controls and article price points as well as facilitating audit and accountability functions. Due to ease of structural modification, such an invention would also contemplate easy vending machine assembly configuration and provide for selection of a combination of individual bulk vending machines most suited to a particular location.

SUMMARY OF THE INVENTION

It is therefore an object of the present invention to provide a vending machine assembly and methodology that improves upon and overcomes the problems known in the bulk vending art.

It is another object of the invention is to provide an improved currency operated bulk vending machine.

Still another object of the present invention to provide a bulk vending machine having advantages of a configurable rack system coupled with easy convertibility and compatibility with existing bulk vending machines that is readily tailored to a particular physical and demographic location.

Still another object of the invention is to provide bulk vending operators with enhanced pricing, accounting, and maintenance controls.

Another object of this invention is to provide a currency based, electrical signal enabling actuatable bulk vending machine which can be incorporated into an array of various machines and has the ability for retrofitting existing machines.

Still another object of this invention is to provide remote telemetry relating to the condition and operability of a bulk vendor assembly.

Yet another object of this invention is to provide of dispensing bulk vending merchandise of various sizes and costs from a common control.

A further object of this invention is to provide a merchandise discharge method and system providing improved monitoring and maintenance capability.

Yet another object of this invention is to provide a bulk vending system with augmented security features.

Another object of this invention is to preserve the perceptible sensation derived from physical manipulation of a conventional crank rotation to achieve dispensing actuation from a bulk vending machine.

A further object of the invention is to provide a bulk vending machine array which includes at least one individual manually actuable machine incorporating electronic locking elements electronically linked to a central currency accepting and control unit.

These and other objects are satisfied by an electronic bulk vending machine assembly, comprising:

a plurality of bulk vending units, each including a merchandise storage globe, a rotatable merchandise dispensing element associated with said storage globe, a base including a dispensing opening, a electronic locking element capable of a switching between a locked state and a unlocked, rotation-permitting state, a manually actuatable rotatable crank handle assembly drivingly connected to said rotatable merchandise dispensing element and disposed to cooperate with said electronic locking element, a locking element control member in signal communication with said locking element associated with an electronic assembly being manually operable releasably lockably connected to said crank handle assembly for allowing limited rotation of said merchandise dispensing control element for controlled dispensing of merchandise from said storage globe to said dispensing opening;

a control unit for transmitting an electronic actuation signal to the electronic locking element to move between said locked state and said unlocked state, said control unit being separate from and in electronic communication with each of said plurality of bulk vending units.

Further objects of the present invention are satisfied by a bulk vending dispensing machine, comprising:

a) a base;

b) a storage container for storing packets for dispensing, set on and above said base;

c) a rotatable distributing member disposed between said base and said container for selecting a discrete packet for distribution quantity of merchandise to be dispensed upon operation of said machine;

d) a dispensing passage for communicating said discrete package to an opening disposed in said base;

e) a manually actuated rotating cranking element operatively engaged with said rotatable distributing member to rotate said member and dispense a packet from the storage container; and f) an electronically actuated locking element for selectively permitting rotation of said cranking element, g) an electronic communication means for communicating an actuation signal from a signal source to the electronically actuated locking element to thereby enable rotation of the distributing member.

Still other objects of the present invention are satisfied by conversion to an improved bulk vending machine incorporating an open topped base with a dispensing opening supporting a storage globe set thereon, a merchandise wheel distributing member disposed between the base and the globe for dispensing merchandise from the globe to the dispensing opening through a dispensing passage extending through the base, the improvement comprising:

an manually rotatable crank handle and actuated gear element operatively engaged with said merchandise wheel to rotate same and communicate an article from the globe, through the merchandise wheel, into the dispensing passage and to the opening an electrically actuated locking control assembly including a member capable of moving between an first position permitting rotation of said crank handle and a second position restricting rotation of said crank, electronic communication means for communicating an actuation signal from a signal source to the electronically actuated gear element to thereby cause rotation of the distributing member.

Still other objects of the present invention concern the method for making or using the foregoing assemblies, systems, machines, and improvements as well as vending articles therefrom and method of monitoring and maintaining such vending machines and assemblies.

The vending machine assembly with centralized electronic currency and accounting controls provided by this invention improves monitoring and, therefore, machine reliability while minimizing the labor and time required for inventory control and to maintain multiple machines in good working order. The invention also provides for use of an array of differently actuated bulk vending machines including at least one machine in the array preserving traditional crank handle actuation dispensing.

Preservation of the organolepticly desirable physical manipulation in an electronic bulk vending array requires an electronically actuated enabling/disabling locking element associated with the hand crank where that element is connected to a central electronic control unit. The electromechanical locking element can comprise any conventional electromechanical control structure but preferably is composed of relatively inexpensive off-the-shelf components such as a solenoid assembly capable of reciprocation between a locking position and an unlocking position based on the detection of an enabling signal from the central control. The solenoid assembly, preferably is associated with a switch that generates a feedback signal upon rotation of the crank handle through a selected arc. Upon communication of such a feedback signal to the central control unit, a further series of enabling/disabling signals can be transmitted by the control unit. Such signals disable previously enabled machines in the array to prevent rotation of the cranks of all of the non-selected machines while continuing to enable the selected machine. Therefore, rotation of the crank handle of a selected machine permits dispensing from that machine to the exclusion of all other bulk vending units in the connected array.

Thus the solenoid controlled coin mechanism described herein provides a variation of the electronically actuated motorized vending delivery mechanism described in the parent application hereto.

As used herein, "bulk vending machine" is intended to embrace its ordinary meaning and in the context of the instant invention, allows for variations and deviations from same which may occur by design or as a result of special features, machining, materials, and other variables. The expression is intended to define the functionality where the storage and dispensing of a type of unique vended item occurs from a unique machine with a pre-established price and which is actuated upon the deposit of the appropriate coinage.

Correspondingly, the word "packet" is intended to embrace a functionality beyond the dictionary definition of a small amount of units or bundle. The word, as used herein is also intended to include any discrete, selected amount of article(s) ranging from one (a single piece of bubble gum or a capsule), to a collective or plurality such as a handful of small candies.

Given the following enabling description of the drawings, the inventive coin operated bulk vending assembly and system and the scope of the invention should become evident to a person of ordinary skill in the art.

DETAILED DESCRIPTION OF THE PREFERRED EMBODIMENT

Figure 1:
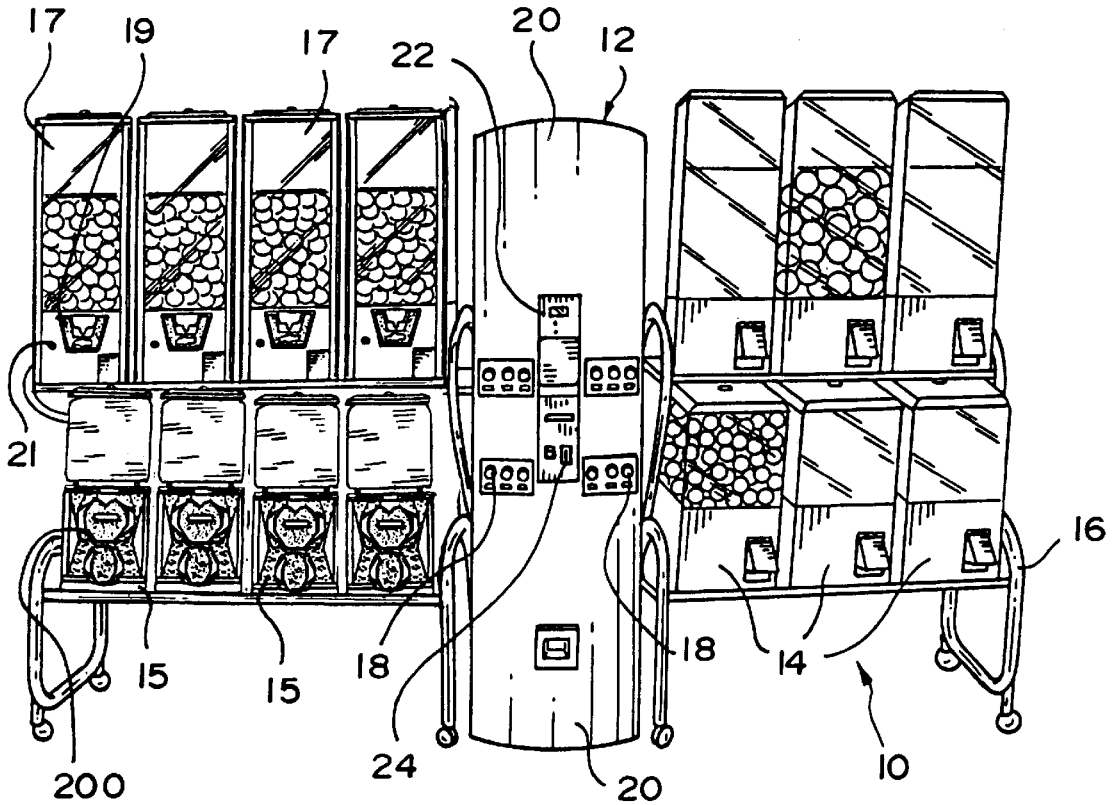
FIG. 1 is a front elevational view of a bulk vending machine assembly embodiment according to the invention.

FIG. 1 depicts an electronic bulk vending machine assembly 10 in accordance with the invention. The assembly features a central electronic control unit 12 flanked on two sides by a plurality of individual bulk vending machines 14, 15, and 17 secured to a pair of machine rack support stands 16. The selection of the various bulk vendors 14, 15, and 17, both in number and size, is determined by the operator to maximize operator organizational flexibility both in positioning and vending features. Any variety of existing bulk vending machines that may be used in this invention including the PN95, PO 89 Model 2001, Zipper, etc. all available from Parkway Machine Corporation. The support stands 16 are physically attached to the central control unit 12, which in the case of the embodiment illustrated in FIG. 1, is characterized by push button actuation. The front door 20 of the control unit 12 features a plurality of detentable, selector push-buttons 18 arrayed on the front panel around a centrally disposed currency acceptor unit 22. A coin acceptor 24 is located below the currency acceptor 22.

Figure 2:
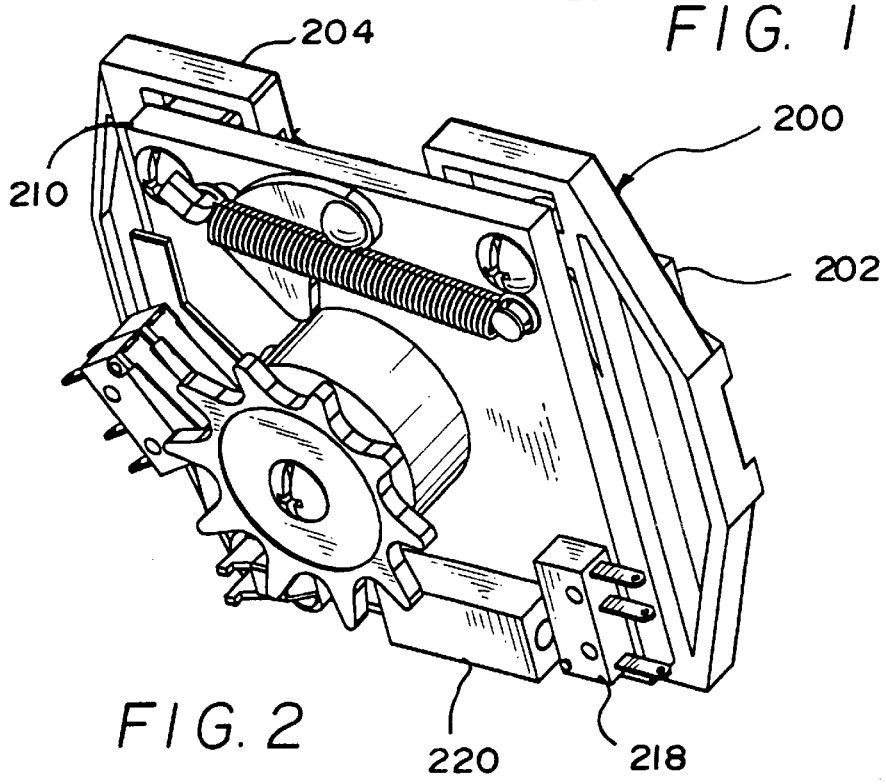
FIG. 2 is a perspective view of an electronically controlled crank assembly according to the invention.

The array of vending machines 14 and the machines 15 and 17 is illustrated to be exemplary and not intended to limit the scope of potential machine combinations. As illustrated, the vending machines 14 correspond to the fully electronically actuated machines of the parent disclosure. However, machines 15 and 17 differ from machines 14 in that they represent different hand crank operated electronically enabled/disabled machines. The machines incorporate a hybrid crank operated, electronically-controlled actuation assembly 200 (See FIG. 2 and the detailed discussion relating to FIGS. 13–15, below.) This assembly 200 communicates with central control unit 12 and both receives and transmits electronic signals therefrom to enable and disable vending from the particular machine. The front of each machine base may include an light emitting diode 21 (LED) or other appropriate electrically actuated visible or audible indicator that is activated upon physical rotational actuation corresponding to that particular bulk vendor.

Figure 3:
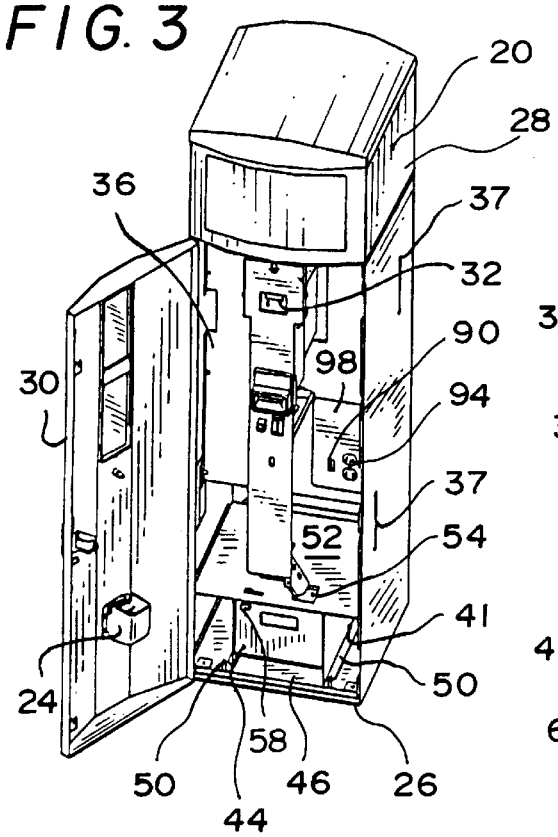
FIG. 3 is a perspective view of a central control unit embodiment according to a further embodiment corresponding to FIG. 1.
Figure 4:
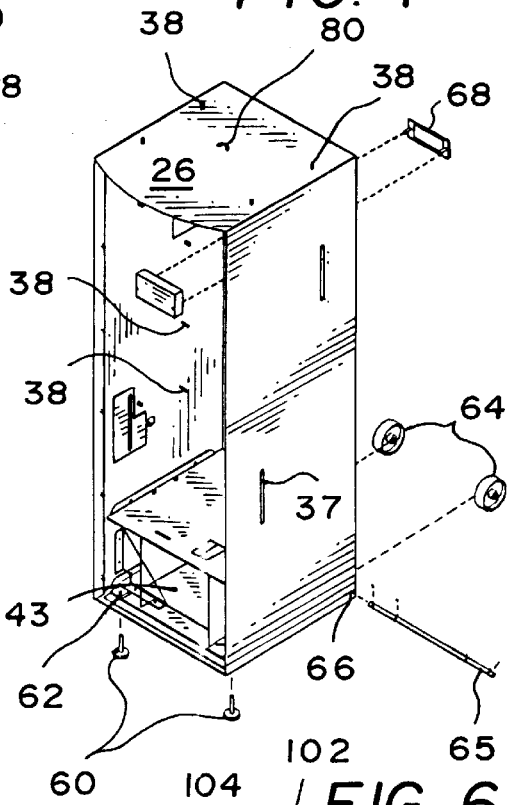
FIG. 4 is an exploded assembly view of the control unit cabinet base of the central control unit embodiment according to the embodiment of the invention depicted in FIG. 3.
Figure 5:
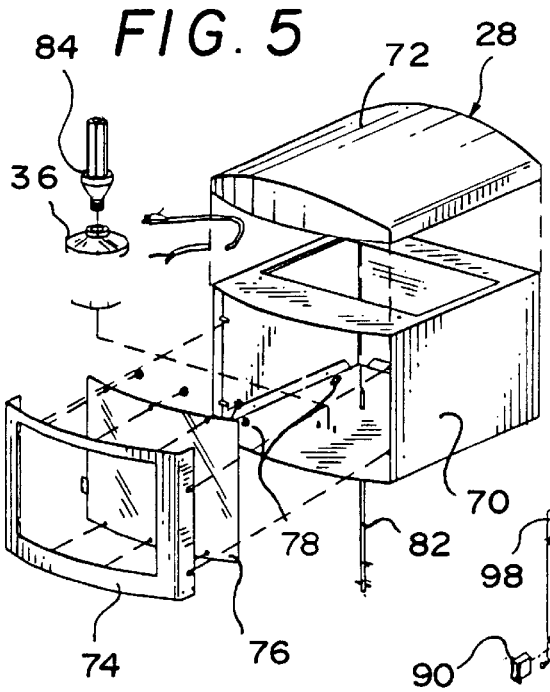
FIG. 5 is an exploded assembly view of the control unit cabinet top of the central control unit embodiment according to the embodiment of the invention depicted in FIG. 3.

FIG. 3 illustrates a variation of the central control unit cabinet 20. This variation incorporates a digital keypad control unit. The unit primarily comprises three segments; a main base cabinet 26, a top unit 28 and a hinge-mounted, latchable, front door panel 30. These segments are formed from a high strength material such as 16-gauge steel to provide adequate structural integrity and strength. Preferably, the steel sheeting is powder coated to minimize deterioration from adverse environmental factors and vandalism. Suitable non-metal materials possessing desirable functional attributes of powder coated steel (e.g. selected polymer compositions and composites) may be substituted for the steel.

The main cabinet 26 provides the rigid and strong housing for the power and control units necessary for actuation of the invention as well as the means for securing the bulk vending machine rack stands in assembly form. The cabinet houses the microprocessor-containing circuit board, the main controller bracket 34 mounted to an internal electrical component vertical support panel 36, currency acceptor components, mechanical and electrical connections for the currency acceptor components, and the coin vault. It also features rack-securing slots 37 formed in each sidewall. The slots 37 are relatively long to facilitate vertical height adjustment of the rack stands relative to the cabinet. The support panel 36 is dimensioned to correspond to the interior width of the cabinet 26 to be nested therein. In the present illustrated embodiment, the panel 36, is secured to the interior side walls of the cabinet 26 by mating a series of projecting pins 38 to a plurality of corresponding complementary L-slots 40 formed on peripheral flange 42 of the support panel 36.

The base of the cabinet 26 contains a lower chamber 41 separated by a steel ceiling panel 52 from the upper portion of the container 26. The coin vault 43 is a steel box for housing the vending assembly coin box 44. As illustrated, the box forming the vault 43 includes two steel sidewalls that extend between the ceiling panel 52 and the floor of container 26. The side panels are physically attached to both the ceiling panel 52 and a pair of upstanding, parallel support beams 50 affixed along the container floor 46. The support beams 50 reinforce the floor 46 and raise the coin box vault 43 above the floor of the container. The vault translatably receives the coin box 44 and may include features such as tracks or some other friction reducing means to facilitate translation of the box from the vault.

The vault-ceiling panel 52 is permanently attached to the interior of the cabinet 26 to define an upper section and the lower, vault sections. Therefore, it also incorporates a coin communicating feedthrough aperture 54 for communication of coins from the currency acceptor into the underlying coin box 44. Finally, the ceiling panel 52 includes a means for locking the coin box within the vault. In the illustrated embodiment, a locking combination is established by a lock lug receiving slot 56 dimensioned to receive a lug from key actuated lock 58 established in the coin box. This arrangement provides a means to prevent unauthorized access to and removal of the coin box from the vault even when the front door 30 is open.

The container 26 also includes features to facilitate secure positioning of central control unit 12. Reinforced, threaded holes 62 located near the front of and at each side of the cabinet floor 46 are adapted to receive threaded leveler guides 60 that provide height adjustability. The back of the cabinet features wheel-receiving recesses for retaining shaft mounted roller wheels 64. A shaft 65 passes through apertures 66 formed along the back bottom portion of the lower chamber 41, through the wheels and is secured with a plurality of locking rings 67. The back of the cabinet 26 also includes a feedthrough for electrical power cord and a handle 68 for grasping and tilting the unit 12 to roll on the wheels.

The top unit 28 of the central control unit 12 features a hollow display weldment 70, a dome top 72, a display front 74 and a display lens 76. The top unit 28 mates with main cabinet 26 when pins 38 pass through pin holes 78. A threaded lock rod 82 compression clamps the top 72 to weldment 70 and to the main cabinet 26 by securing it in feedthrough 80 formed in the top of the cabinet 26. In this manner the individual segments are combined to form a secure unitary structure but also permit stacking of additional top units above the main cabinet, when desirable. That feedthrough also accommodates an electrical conduit from the main cabinet to the top unit. The top unit may incorporate a static (illustrated) or dynamic display to attract potential purchasers or to provide advertising. As illustrated the top unit includes a light 84 and light fixture 86 that illuminates a translucent display lens 76 framed by the display front 74.

Figure 6:
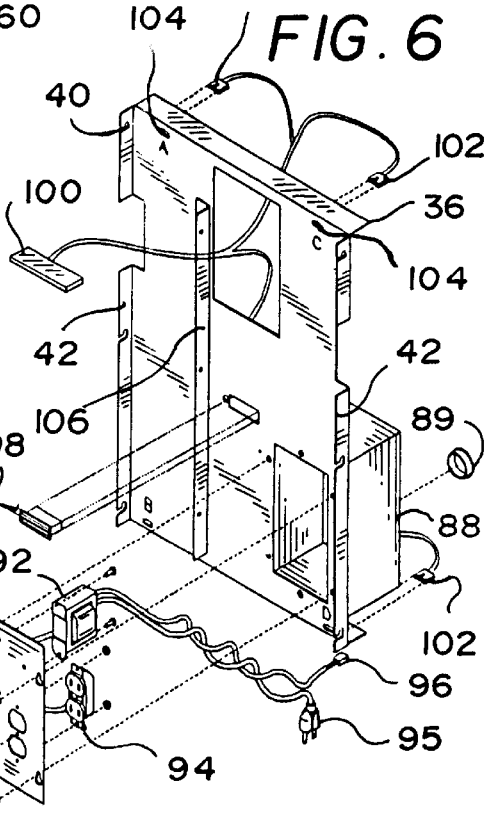
FIG. 6 is an assembly view of control unit mounting panel for mounting in the cabinet base of the central control unit embodiment according to the embodiment of the invention depicted in FIG. 3.

Referring to FIG. 6, the electrical component mounting panel 36 provides secure mountings for the electrical junction box 88 which houses circuit breaker 90, transformer 92, and electrical outlet 94 along with associated power cord 95, wires, and pin connector 96. The junction box 88 includes a power cord feedthrough protected by bushing 89 and is covered by a panel 98 which also serves as a seat for the circuit breaker 90. The main pin connector 100 is connected to power pin connector 96 to provide electricity to the control panel and to communicate electrical signals to the shelf pin connector harnesses 102 seated in pin harness openings 104 located proximate to each of the corners of the panel 36. A longitudinal hinged, L-bracket 106 is welded vertically along the front face of the panel next to centrally located permanent magnet 108, both of which serve to secure the currency acceptor unit 22.

Figure 7:
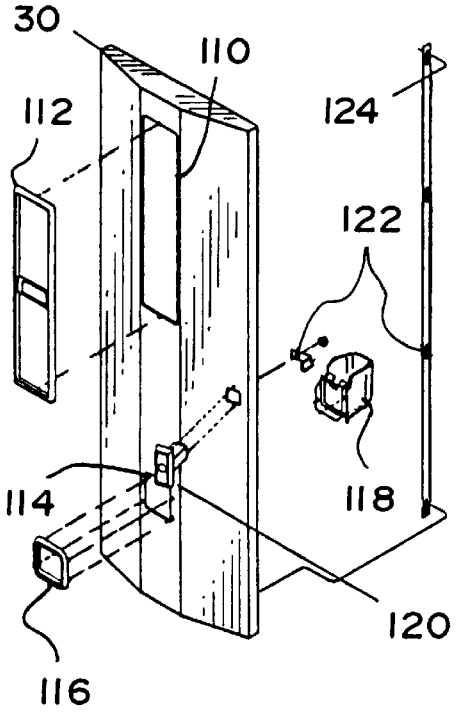
FIG. 7 is an assembly view of the front door panel and latching arrangement of the central control unit embodiment depicted in FIG. 3.

In FIG. 7, the hinge mounted steel door 30 that secures the main cabinet 26, is illustrated. Steel door 30 includes a central vertically oriented currency acceptor aperture 110 which is framed by a coin acceptor bezel 112. Disposed below the aperture 110 is a second aperture 114 framed by coin return bezel 116 that serve to secure coin return cup 118 under the currency acceptor unit 22. The door also includes a T-handle lock 120 that rotates cam 122 that translates a locking latch bar 124 to engage complementary lug structures within the cabinet 26.

Figure 8:
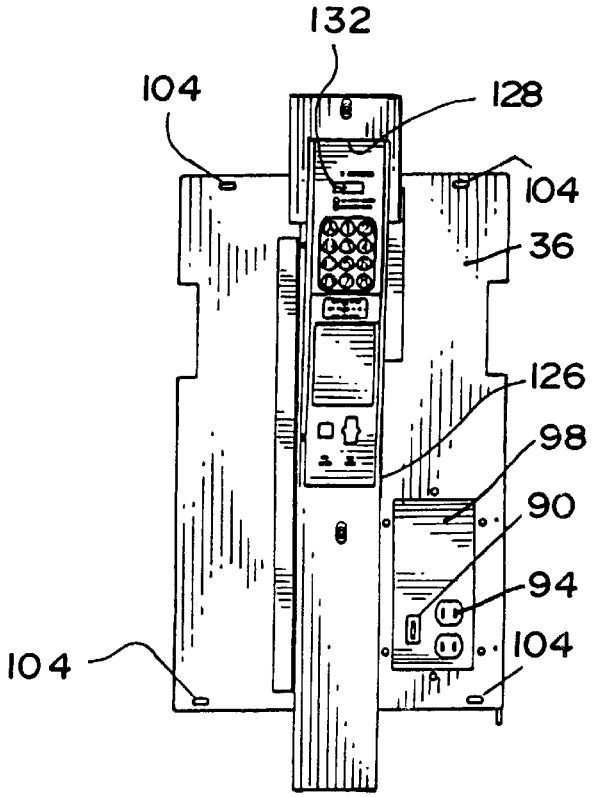
FIG. 8 is a front view of a control unit housing of the embodiment of the electronic controller and keypad as mounted on a panel according to FIG. 6 in accordance with one embodiment of the invention as depicted in FIG. 3.
Figure 9:
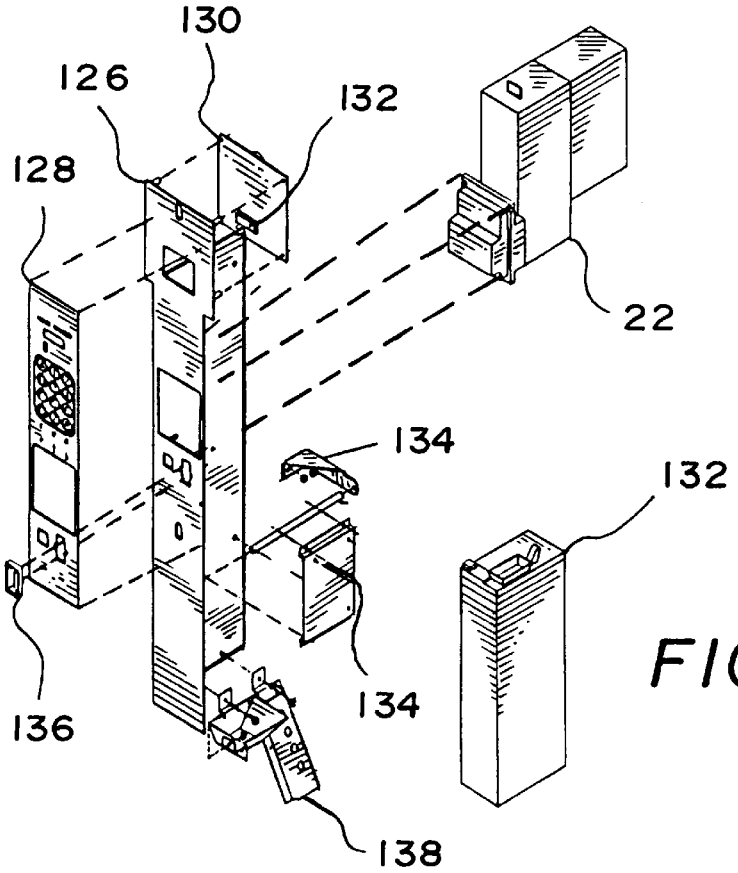
FIG. 9 is a perspective assembly view of an electronic controller and keypad including currency acceptor elements in accordance with the embodiment according to the embodiment depicted in FIG. 3.

A detailed view of the currency acceptor mechanism is illustrated FIGS. 8 and 9. The currency acceptor, in the illustrated embodiment includes both a bill validator of the type disclosed in U.S. Pat. No. 4,880,096 and a coin acceptor of the type disclosed in U.S. Pat. No. 4,739,869 and its cognate Canadian Patent 1,251,862 (the subject matter of all being incorporated herein by reference). The L bracket 126 secures the keypad 128 on its front and preferably is mounted to the support panel 36 along bracket 106 in a manner to permit pivoting for easy access to the supported components. It also secures the microprocessor-controlled circuit board 130 on its backside. The circuit board 130 includes an electronic display (either Liquid Crystal or LED) 132 facing outward for visual access from the front. The currency acceptor elements include the bill acceptor mounted to the L bracket 126 and coin acceptor 132 mounted to the L bracket 126 with the bracket 134. Preferably, the bracket 134 is formed of a ferrous metal so that it is releasably attracted to the magnet 108 attached to the support panel 36. The coin acceptor 132 is in coin communication with coin receiving slot member 136 mounted on the front of the bracket 126. The coin dispensing chute 138 is disposed below the coin acceptor 132 to pass coins from the acceptor to the coin box in vault 44.

Figure 10:
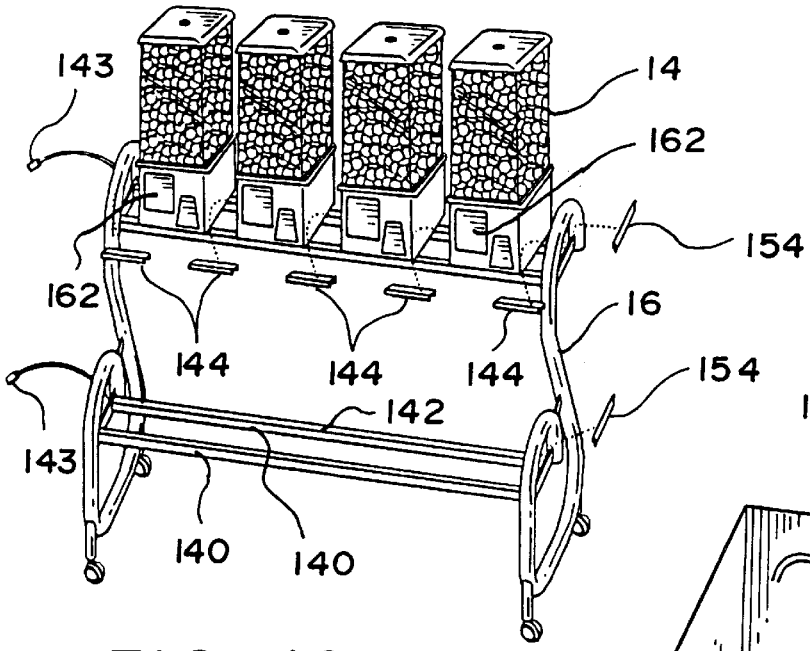
FIG. 10 is a perspective partial assembly view of a multi-machine stand and illustrative bulk vending units according to the embodiment of the invention depicted in FIG. 1.
Figure 11:
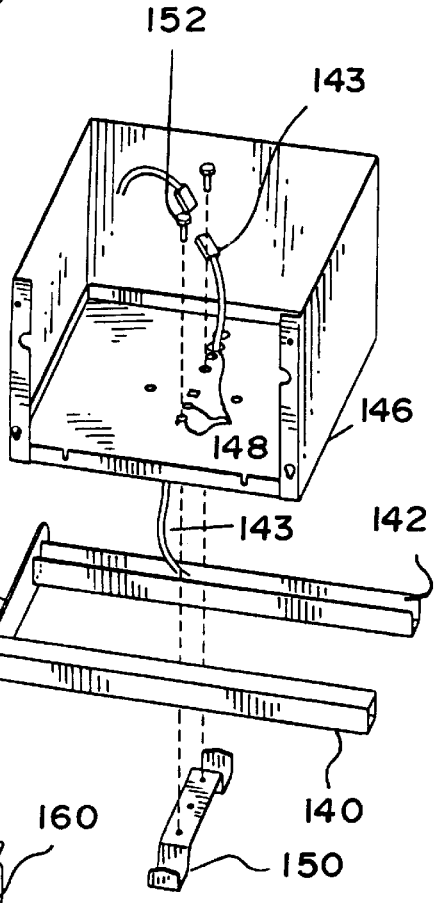
FIG. 11 is a perspective assembly view of a bulk vending machine base and mounting bracket adapted to be used in the embodiment of the invention depicted in FIG. 1.
Figure 12:
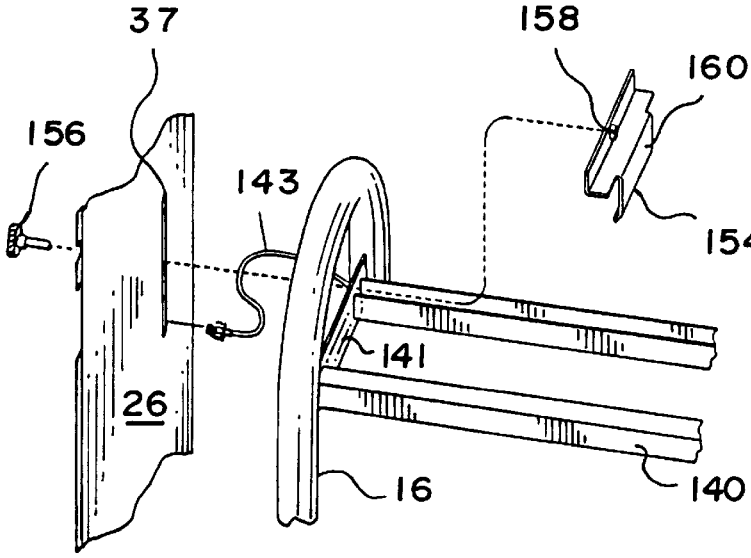
FIG. 12 is a perspective partial assembly view of a multi-bulk vendor machine stand and central control cabinet according to the embodiment of the invention depicted in FIG. 1.

Turning now to the rack and machine attachment structures, FIGS. 10–12 show an array of machines 14 positioned on one shelf of a stand 16 and respective attachment means therefor. The stand 16 may be of any conventional type but, preferably, to accommodate the wiring and harnesses required for the instant invention, it is a modified form of the stand depicted in Design Patent 381,169 for a stand, the disclosure of which is incorporated by reference herein.

The multi-machine stand 16 features at least one channel 142 formed in one of the lateral shelf pair members to recess wire/harness cable 143. A plurality of channel caps 144 are seated over the channels 142 in a spaced apart relation leaving gaps for passage of the wire/cable 143 but coacting with the base 146 of the bulk vending machines to form a complete, integral channel cover extending over the entire length of the channel 142. The base 146 includes a plurality of preformed holes 148 of various sizes. Some of the holes 148 comprise feedthroughs for passing the cable harness 143 into the machine base, and others are for mounting a particular bulk vending machine 14 to a shelf of the stand 16. Following positioning of a machine on a shelf and overlying a pair of caps 144, machine bolts 152 are threaded through the machine base 146 to a machine clamp bracket 150 that clamps over the shelf members. Because the bolts are secured from the inside of the machine base, absent significant force, the machine base cannot be dislodged from the shelf and the cable protecting channel caps are also secured. It is also possible to retrofit conventional vending machine stands by forming the appropriate mating holes between a machine base and stand shelves.

The rack stand attachment relies on a stand clamp bracket 154 being compression clamped to the side of the central control unit 12. When the rack stand 16 is moved (caster roller facilitated) to a position contiguous to slots 37 in cabinet 26, the wire harness cable 143 is passed through slot 37 for connection to the appropriate wire pin harness 102 and the stand clamp bracket is aligned with the slot. The clamping knob 156 is screwed from the inside of the cabinet 26 through the slot 37 and into the mating threaded hole 158 formed in the stand clamp 154. The downwardly projecting engagement lip 160 compressibly clamps over the stand cross support strut 141. This is repeated on for the other shelf thereby establishing two attachment points per stand to the central control unit 12. To minimize risk of tampering, the stand should be clamped to the control unit prior to clamping the interior-most bulk vending machines to the shelves.

Referring now to the structure of the present invention distinguishing it from that of the parent application., The fully automated, motorized merchandise wheel rotating assembly is replaced by traditional hand crank actuation utilizing electronic enablement/disablement and feedback features.

Figure 13:
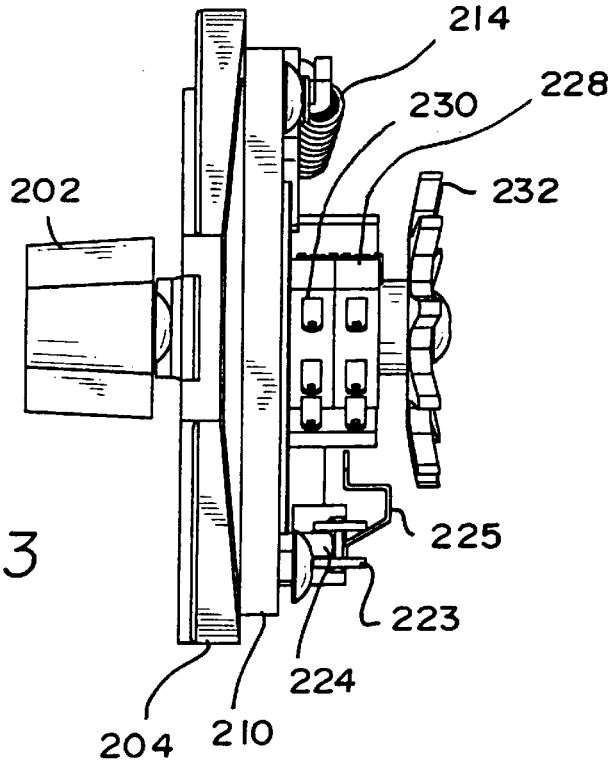
FIG. 13 is a side view of the electronically controlled crank assembly depicted in FIG. 2.
Figure 14:
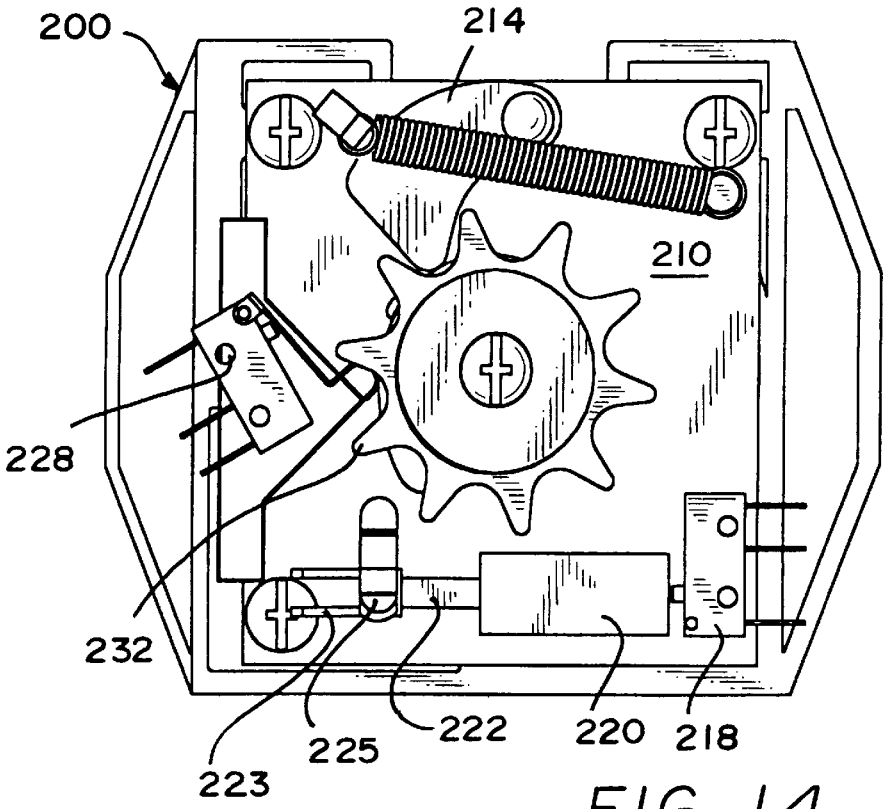
FIG. 14 is a back view of the electronically controlled crank assembly depicted in FIG. 2.
Figure 15:
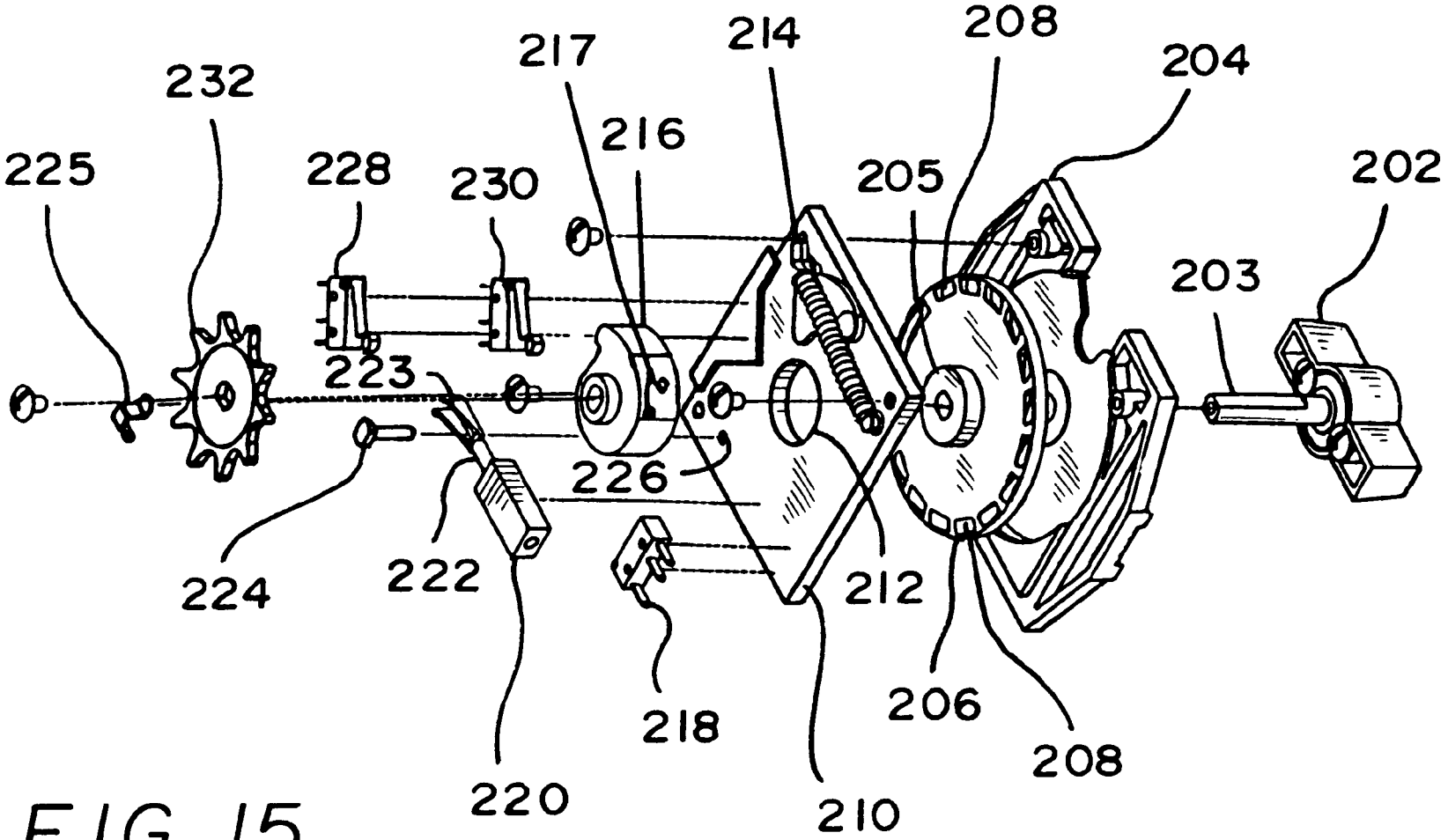
FIG. 15 is an exploded view of the electronically controlled crank assembly depicted in FIG. 2.

In FIGS. 13–15, a version of the assembly 200 is illustrated. Dimensionally, assembly 200 corresponds to the conventional coin receiving mechanism structure of the particular vending machine model. Projecting from the front of a faceplate 204 is conventional crank handle 202. Rearwardly directed shaft 203 projects from the back of the rotatable crank handle 202 and passes though a corresponding opening in the face plate 204. At the front, the mechanism provides the identical appearance to a fully mechanically operated, conventional crank handle mechanism. Otherwise, as should be apparent to the person of ordinary skill in the art the coin-receiving slot is rendered nonfunctional by the detenting control wheel 206.

The control wheel 206 is rotatably mounted behind the faceplate 204 and includes a reinforced boss 205 through which shaft 203 passes. The control wheel 206 substitutes for the coin wheel of a conventional hand crank, mechanically actuated bulk vendor and, therefore, to provide equivalent function, includes a ring of detenting holes 208 sized to receive a detent pin (described below) and to register the home position of the assembly and to prevent reverse rotation. The control wheel 206 is sandwiched between the cover plate 204 and a mounting plate 210 that is fixedly mounted to the cover plate 204 using screws or other appropriate attachment elements.

The mounting plate 210 includes a central opening 212 sized to receive and register the boss 205., A home position pawl and spring arrangement 214 is mounted on the mounting plate 210. A cam 216, preferably composed of nylon, is mounted on the shaft 203 behind the mounting plate 210 and abutting the boss 205, features a large single tooth indicating the home position and a pair of offset micro-switch tripping lugs 217. n FIG. 15, the cam 216 is rotated 900 from the home position for clarity to clearly illustrate the tooth and micro-switch trip lugs 217. Thus, in addition to the inherent spacing function, the cam 216 serves two operational functions; to identify and register the home position and to trip micro switches 228 and 230 upon a selected degree of rotation.

The electrically controlled locking assembly of the present invention includes solenoid switch 218 connected to solenoid control 220 both being attached to the mounting plate 210. The solenoid control 220 incorporates translatable reciprocating arm 222 including a pair of triangulating tines 223. A detenting lock pin 224 moves between an unlocking-dispensing enabling position and a locked position where it projects through hole 226 in mounting plate 210 and into one of the detent holes 208 of the control wheel 206. When inserted into the detent hole 208, the pin 224 prevents rotation of wheel 206 and therefore, dispensing of merchandise. The head of the lock pin 224 is mounted between the tines 223 and engages a lock pin spring 225 mounted appropriately on the mounting plate 210. The lock pin spring 225 biases the lock pin 224 in the detenting locked position.

Micro-switch 230 is mounted to the mounting plate 210 and micro-switch 228 is mounted on micro-switch 230. These micro-switches are mounted proximate to the cam 216 so that the switch arms deflect upon contact with the lugs 217 upon rotation of the crank handle 202. A conventional merchandise wheel drive gear 232 is seated at the back end of shaft 203 and is secured with a screw 234.

The foregoing structure permits electrical enablement of a hand-crank bulk vending machine. Upon deposit of adequate currency in the central control an enabling signal is passed from the control to the solenoid switch 218. Switch 218 causes the solenoid 220 to retract arm 222. As arm 222 retracts, the head of the detenting pin cams against the triangulating tines 223 with sufficient force to overcome the biasing force of spring 225. Thus, as the pinhead rides up the triangulating tine surfaces, the pin shaft is retracted from control wheel 206, enabling rotation thereof. Upon rotation of the crank handle 202, the rotation of the cam 216 overcomes the spring force and displaces home positioning pawl 214. As the cam 216 rotates, the arm of the microswitches 228 and 230 contact the lugs 217. Once the lugs are contacted by the switch arms thereby closing the respective switch circuits signals are transmitted to the central control unit which identify the machine being operated and to disable all other machines in the array that were enabled by the currency deposit. The two switches are preferred to provide for either redundancy or facilitating machine identification in a large array. For example, switch 230 could be equivalent to pushing the 'A' button on the key pad and switch 228 could be equivalent to pushing the "1" button. Thus, in this example, the switches would identify the particular machine to the central control unit as the 'AI' vending machine In relation to retrofitting existing machines, the crank handle in a fully mechanical actuating mode is retained on the front of each of the vending units for sensing by purchasers.

Although not illustrated, an auxiliary printed circuit board can be incorporated on the control panel to facilitate the vending supervisory function by monitoring credit and the individual vending machine price setting and to provide signal actuation, visible or audible can be used to indicate that the machine is qualified to vend articles based on the amount of deposited currency. Thus, the customer can readily identify the machines that are ready to vend. Alternatively, the supervisory circuitry can be included in the central control unit for connection to the mechanically actuated machines in the array. The circuitry would programmed to activate the indicator lamp 21 on a particular machine or set of machines qualifying for dispensing based on the amount of deposited coinage.

Given the foregoing structural descriptions of the various aspects of the present invention in the illustrated embodiment, the following provides a brief discussion of the installation, utilization and operation, of the above described.

In most aspects of operation, the electromechanical hybrid bulk vending machines according to the present invention, perceptually provide operation much like that of conventional bulk vending machines. The vend cycle commences by deposit of sufficient currency (albeit that the deposit is made into the controller 20).

Once the coin acceptor of the central control unit has detected the deposit of money meeting or exceeding the set vend cost, the lock solenoids of all the individual vending machines having a vend price setting at or below the qualified deposited amount, are released to permit rotation of the mechanism. At the same time the lock solenoid is pulled, the vend enabling indicator light on the front of the machine is activated to indicate that the machine is ready to vend. The enable/actuation signals remain only until one of the enabled crank handles is rotated through a selected arc, e.g. 45 degrees or if a hybrid array, the deposited funds fall below the required level. In the electromechanical machines of the present invention, once the selected crank handle is rotated through a selected arc, the micro-switches are activated generating a feedback signal that is communicated to the central control which in turn disables/terminates the enable actuation signal to all but the selected vendor unit. The customer completes the rotation of the crank handle to complete the vend. The merchandise is vended to the "Thank You" door and the crank handle mechanism 200 is returned to its home position. The customer can then make another selection from any machine for which sufficient credit remains, or, if a credit remains, can press the coin return to obtain any balance due.

Operationally, the controller sends an electrical single to the selected machine's solenoid. The solenoid pulls and latches and sends a return signal to the controller to inform the controller that the vend is complete. The pulled solenoid enables the customer to continue to rotate the handle passed the 45° free rotate position. Where, the solenoid is not pulled, the rotate stop pin is not lifted out of the mechanism's control wheel 206 home position and therefore, the rotation of the handle 202 cannot continue. Thus, no vend is made and the customer retains full credit of the deposited currency thereby enabling another vend selection or full refund. However, once the solenoid is pulled and latched, the customer would continue to turn the handle. As noted above, the rotary control wheel is associated with typical non-reverse elements to prevent backward rotation of the handle. A supplementary non-reverse feature may be incorporated whereupon exceeding a specified degree of rotation, the solenoid is released from the latched position to return to its home position, thereby assisting to prevent reversing direction of the mechanism.

Referring now to the assembly of a bulk vending machine array in accordance with the invention, the first step for the operator is to select the desired individual bulk vendors (retrofitting with electro-crank or motor mechanisms when necessary). In order to assemble the rack stands 18 and machines 14, 15, and 17, the appropriate cables/wiring harness must be installed in the slotted channel. The right and left side rack assemblies will be mirror opposites and each will include the cable ends and shelf end cover guards at opposite ends. The shelf harnessing, corresponding to the number of machines to be installed on a shelf is placed in the channel and the main connector passed through the feedthrough in the upright next to the main control unit. An appropriate number of channel caps is selected to cover any open area of the channel and conceal the harnessing between machines.

After preparation of the racks is complete, then the machines must be secured to the shelves. The wiring harness must be passed onto each machine and plugged into the connector associated with the motor in the base of the machine. Channel caps of appropriate length are placed over the open channel on the shelf on each side of the machine and the machine positioned on the shelf in a manner to overlap the channel caps. The machine is then clamped onto the shelf using the metal mounting bracket under the base of the machine and about the shelf threading the connecting bolts from the inside of the vending base into the mounting bracket. Properly installed, the machine will positionally secure the shelf channel caps and conceal the harnessing lying in the channel.

After assembly of the select number of bulk vending machines 14, 15, and 17 on the rack stands, the machine/stand array is attached to the side of the control unit cabinet 26 using the rack mounting knobs and mounting brackets. First, the wiring harness is passed through the appropriate slot 37 in the side of the control cabinet. Next, for each rack shelf, a rack clamp must be positioned around the shelf end plate and the rack knob threaded from the inside, through the slot 37, and into the clamp.

Following completion of the foregoing, each of the wiring harnesses is attached to the appropriate plug-in pin connector located at the four corners of the on vertical support bracket 36. Typically, the upper left connector is used for the machines on the upper left rack; the lower left connector is used for the machines on the lower left rack, etc. Once completed, the mechanical assembly aspects of the system should be complete.

The next steps relate to electronic operation. The currency acceptor (as illustrated the bill acceptor and the coin changer) must be initialized. Initially, some coins should be placed in the changer, but under normal operating conditions, the coin changer is self-filling.

To set the central control unit and machine array, it is necessary to unlock and open the door 30 of the central control unit 12. To access the control board and currency acceptors of the main control panel, pivot the hinged panel to overcome the magnetic force holding it in the closed position. To program the unit, it is first necessary to enter the service mode by pressing and releasing the mode button located on the control board. (Toggling the mode button again will exit the service mode and return the control board to the sales mode.) The unit is provided with a fail-safe feature to prevent accidents. If the programming sequences are not initiated within 25 seconds as detected by an absence of keypad activity, the control board automatically reverts to the sales mode.

The first display is of diagnostic indicators on the digital display. These will be displayed until entry of subsequent programming functions. Such diagnostics include the number of configured motors, multi-drop bus errors, defective or jammed motors, etc. Examples of various programming functions, include for example, the following permanent modes:

Coin Dispense—This mode is used to empty the coin tubes of the changer.

Motor/Electro-Crank Count.—This mode displays the number of motors and electro-crank machines corresponding to the number of individual bulk vending machines 14, 15, and 17 installed on the racks 18;

Accounting—In this mode the total vend count and the total cash count is displayed, preferably both as cumulative totals which are not resettable to both minimize tampering and facilitate tracking the total number of vends/money collected by each respective unit.

Setting Prices—This mode provides for operator flexibility by allowing each machine to be set at a unique vending price point. After identifying a particular machine, the vending actuation price is set by pushing the "↑" arrow key to increase the price displayed on the LCD or LED display and the "↓" arrow to decrease the price.

Test Vend—This is a currency-less transaction mode employed to confirm proper operation of the electrical connection between the selector and a particular machine. Dispensing of a product from the appropriate machine indicates a successful test. Failure is indicated on the display.

The control pad also permits an operator to customize each vending machine assembly by setting the following optional modes:

1 Force Vend—When activated, the Force Vend requires a purchase to be made once the customer has inserted money into currency acceptor. No change is returned until a selection is entered on the keypad. When deactivated, the customer may push the coin return and receive money back in change without making a purchase.

2. Bill Escrow—This mode determines if the customer will receive the original currency bill or change. It is related to the Force Vend option insofar as, when activated, the Force Vend mode overrides the Bill Escrow mode.

3. Multi-Vend—This optional mode permits the operator to set a price point at which change is automatically returned to the customer following a vend. Assuming a customer makes a purchase but does not use all of the deposited money deposited in the machine, the amount remaining in "escrow" is displayed and may be used to make an additional purchase or, at the election of the customer, can be retrieved the remaining balance by pushing the coin return button. The escrowed amount will also be returned automatically after 25 seconds if no subsequent action (selection or deposit) is made.

5. Free Vend—This option puts the entire assembly in a free play operational mode and over-rides any price settings.

The above-described bulk vending machines are particularly useful in multiple machine/rack arrangements and are readily adaptable for a variety of potential applications including electronic vending. A bulk vending assembly of the type contemplated by this invention may also incorporate a number of various options to facilitate troubleshooting, minimize vandalism, and assist with data collection and inventory control.

Each unit may include an electronic optical or electro-optical detector associated with the dispensing opening of each merchandise wheel to confirm the presence or absence of a vend. A vend failure can be caused by any number of problems that face bulk vending machine operators using conventional machines. However, jamming problems etc. can be detected, confirmed, and corrected much more quickly given the appropriate telemetry which can be accessed on site or remotely. For example, if a product jams in the merchandise wheel, it will not only prevent a vend but may prevent the selected vendor motor from turning. This failure could be detected using the vend confirmation sensor and relayed to the operator by on-site interrogation or automatic interrogation and remote information transmission using a telemetry transceiver system located in he central control unit. Such information transmission may relate to the entire assembly or may address individual units. Such information may include the operability of the machine, the number of vends, the amount collected since the last refill, etc. which is useful for maintenance and inventory control.

For example, as in the case of conventional machines, coins can become jammed in the coin acceptor which must be dislodged to permit full operation. This suboptimal condition may be detected by the machine and relayed to an appropriate central control.

Another concept relates to security. A digital camera may be installed in the domed top section that allows for period scheduled recordation of traffic about the unit and may be associated with sensors to activate upon the occurrence of any unauthorized or unlawful activity involving the machine. Thus, machine is capable of storing or transmitting information that provides the operator with demographic characteristics of the user population and/or enhanced security.

The following discussion concerns the electronic accounting or audit system and method contemplated to be used with the above-described systems. As contemplated, the auditing system used in connection with the invention is fully automated and permits data gathering with complete cash and audit detail reporting capabilities. Once established, the audit accounting system provides detailed information about the vending activity of the entire system as well as about the individual bulk vending machines with which it is associated. Typically, the auditing system will enable production of reports, for example, of total money in the coin changer, cash box, and/or bill acceptor, the total number of vends by the system, per machine, and by selection. So long as fundamental system information is present, e.g., the machine serial number, the identification of the bulk vending machines the name of the location, the route number and the time increment (day, week or month), the operator may retrieve the information on location or remotely through an appropriate telecommunications link.

Preferably, for security reasons and consistent reporting operations, the audit function are accessible to only Key operator personnel and the software is designed to permit access to any one site one at one time. The software is installable on a conventional PC meeting minimum operating requirements and is provided with an appropriate link for receiving the data from the central control units. There are several interrogation hardware options including hard wiring to the audit computer, telephoneline/modem linkage, radio transceivers, satellite communication uplink-downlink hardware, and even a hand held portable probe including an infrared transmitter or a serial port. Once the data is transferred, the particulars of its use depend on the specifics of the operator's requirements and therefore, are not detailed here.

The above-described embodiments have been directed to currency receipt only. However, the invention contemplates other redemption faculties. For example, the invention can be used for redeeming tickets or other transactable media such as that used in entertainment arcade centers, at charity events, and the like. Also where all of the vending machines in the array comprise the electro-mechanically based-solenoid-controlled mechanism, the central control unit need not include the keypad but only the currency acceptor elements. The central control unit buttons or keypad are replaced where the selection is made exclusively by partial rotation of the crank handle in accordance with the foregoing. However, where hybrid systems are used, the actuation buttons or keypad must be retained for fully automated vending.

In summary, this inventive electronic vending machine system and assembly incorporates an independent, mechanically actuatable bulk vending machines for dispensing product associated with each such machine where each such machine is in communication with a central control unit and each machine incorporates an electro-mechanically actuated locking element to releasably lock the associated, manually actuated crank mounted on the front of the individual bulk vending unit.

Given the foregoing, variations and modifications to the invention should now be apparent to a person having ordinary skill in the art. These variations and modifications are intended to fall within the scope and spirit of the invention as defined by the following claims.

We claim:

1. An electronic bulk vending machine assembly, comprising:

a plurality of bulk vending units, each including a merchandise storage globe, a rotatable merchandise dispensing element associated with said storage globe, a base including a dispensing opening, a electronic locking element capable of a switching between a locked state and a unlocked, rotation-permitting state, a manually actuatable rotatable crank handle assembly drivingly connected to said rotatable merchandise dispensing element and disposed to cooperate with said electronic locking element, a locking element control member in signal communication with said locking element associated with an electronic assembly being manually operable releasably lockably connected to said crank handle assembly for allowing limited rotation of said merchandise dispensing control element for controlled dispensing of merchandise from said storage globe to said dispensing opening;

a control unit for transmitting an electronic actuation signal to the electronic locking element to move between said locked state and said unlocked state, said control unit being separate from and in electronic communication with each of said plurality of bulk vending units.

2. The assembly according to claim 1 further comprising a currency receipt mechanism in said control units.

3. The assembly according to claim 2 where the currency receipt mechanism accepts both coinage and paper currency.

4. The assembly according to claim 3 where the control unit permits assignment of a currency deposit requirement for a select one of said vending units to permit actuation of the select vending unit where each vending unit is assigned a currency deposit requirement.

5. The assembly according to claim 2 where said rotatable merchandise dispensing element includes toothed gearing and said manually actuatable rotatable crank handle assembly includes a gear that meshes with said rotatable merchandise dispensing element gearing, coacting therewith and with said electronic locking element where said locking element moves between an electrically actuated unlocked, rotation permitting state and a non-actuated, locking state that prevents rotation of the crank handle and therefore the merchandise dispensing element.

6. The assembly according to claim 2 where said control unit comprises an electronic feedback solenoid that is electrically actuated upon a selected degree of rotation of a crank and a lamp linked to a solenoid to display the enabled state.

7. The assembly according to claim 6 where the selected degree of rotation is an arc of about 45° and upon which an electrical feedback signal is produced where the central control unit imparts a rotation enabling signal to the selected machine but prevents the crank handles of all non selected machines in the array from rotation.

8. The assembly according to claim 1 further comprising a rack stand supporting and securing said plurality of vending machines in a manner that each is accessible for vending, said stand providing a secure feedthrough for electro-optical communication conduits extending between said control unit and each of said plurality of vending machines.

9. The assembly according to 8 where the electro-optical communication conduits includes a bundle of electrically conductive wires, at least one of said wires comprising said bundle being in electrical communication with a select one of the bulk vending units comprising said plurality of bulk vending units where said electro-optical conduit connecting the plurality of bulk vending machines to said control unit and further comprising a vend selection indicator associated with each one of said plurality of bulk vending units to visually indicate the vend selection corresponding to the particular bulk vending unit selected, said vend selection indicator being connected to said electrically conductive wires.

10. The assembly according to claim 1 where the control unit comprises a cabinet for housing an electronic currency receiving element, electronic circuitry for accounting for the deposited money, for receiving selection signals from a user selection means, and for transmitting the electronic actuation signal to the electronic driving means of the selected bulk vending unit.

11. The assembly according to claim 10 further comprising visual display member associated with the central control unit where the central control unit is secured within the cabinet, a transmitter element for transmitting information from the central control unit to a receiver, and a camera for monitoring the environment.

12. The assembly according to claim 1 further comprising a currency receipt mechanism in said control units and where said merchandise storage container is a globe.

13. The assembly according to claim 12 where there is a plurality of bulk vending units each having its own base and each base supporting a separate globe.

14. The assembly according to claim 12 further comprising a plurality of bulk vending units where each bulk vending unit has a base and said dispensing opening is located in the base.

15. A bulk vending dispensing machine, comprising:

a) a base;

b) a storage container for storing packets for dispensing, set on and above said base;

c) a rotatable distributing member disposed between said base and said container for selecting a discrete packet for distributing a quantity of merchandise to be dispensed upon operation of said machine;

d) a dispensing passage for communicating said discrete package to an opening disposed in said base;

e) a manually actuated rotating cranking element operatively engaged with said rotatable distributing member to rotate said member and dispense a packet from the storage container;

f) an electronically actuated locking element for selectively permitting rotation of said cranking element; and g) an electronic communication means for communicating an actuation signal from a signal source to the electronically actuated locking element to thereby enable rotation of the distributing member; wherein the electronically actuated locking element comprises micro-switches and solenoids and at least one of said micro-switches provides a feedback signal to the central control unit.

16. The assembly according to claim 15 further comprising a transceiver means for transmitting means for sending said data to a remote central controller and for receiving instructions and information therefrom including inventory and maintenance data.

17. An electronic bulk vending machine assembly, comprising:

at least one bulk vending unit including at least one merchandise storage container, a rotatable merchandise dispensing element associated with said storage container, a base including a dispensing opening, a electronic locking element capable of switching between a locked state and a unlocked, rotation-permitting state, a manually actuatable rotatable crank handle assembly drivingly connected to said rotatable merchandise dispensing element and disposed to cooperate with said electronic locking element, a locking element control member in signal communication with said locking element, said locking element being movable between a locking and unlocking state and being engagable with to said crank handle assembly for allowing limited rotation of said merchandise dispensing control element for controlled dispensing of merchandise from said storage container to said dispensing opening when in said unlocking state;

a control unit for transmitting an electronic actuation signal to the electronic locking element to move between said locking state and said unlocking state, said control unit being separate from and in electronic communication with said at least one bulk vending unit.

* * * * *